US007329384B2

(12) United States Patent
Shinkai et al.

(10) Patent No.: US 7,329,384 B2
(45) Date of Patent: Feb. 12, 2008

(54) POROUS METAL BASED COMPOSITE MATERIAL

(75) Inventors: Masayuki Shinkai, Ama-gun (JP); Masahiro Kida, Ama-gun (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/957,730

(22) Filed: Sep. 21, 2001

(65) Prior Publication Data

US 2002/0059968 A1 May 23, 2002

(30) Foreign Application Priority Data

Sep. 29, 2000 (JP) ..... 2000-301492

(51) Int. Cl.
*C22C 21/00* (2006.01)

(52) U.S. Cl. ..... 420/528; 148/437

(58) Field of Classification Search ..... 428/545, 428/293.1; 148/437; 420/528
See application file for complete search history.

(56) References Cited

U.S. PATENT DOCUMENTS

| | | | | |
|---|---|---|---|---|
| 4,565,744 | A | 1/1986 | Walter et al. | |
| 5,006,417 | A * | 4/1991 | Jackson et al. | 428/614 |
| 5,072,689 | A * | 12/1991 | Nakagawa et al. | 118/419 |
| 5,626,692 | A * | 5/1997 | Rohatgi et al. | 148/538 |
| 5,900,277 | A | 5/1999 | Fox et al. | |
| 6,051,045 | A * | 4/2000 | Narula et al. | 75/233 |
| 6,183,877 | B1 * | 2/2001 | Bell et al. | 428/545 |
| 6,348,273 | B1 * | 2/2002 | Ishikawa et al. | 428/621 |
| 6,440,578 | B1 * | 8/2002 | Shinkai et al. | 428/548 |

FOREIGN PATENT DOCUMENTS

| | | | |
|---|---|---|---|
| EP | 0 340 957 | A2 | 11/1989 |
| EP | 0 368 783 | | 5/1990 |
| EP | 1 093 882 | A1 | 4/2001 |
| JP | 61-270376 | A | 11/1986 |
| JP | 01-132763 | A | 5/1989 |
| JP | 01268829 | A | 10/1989 |
| JP | 02-182844 | A | 7/1990 |
| JP | 4-110440 | | 4/1992 |
| JP | 04110440 | A * | 4/1992 |

OTHER PUBLICATIONS http://mathworld.worlfram.com/SpherePacking.html, "Cell Aggregation and Sphere Packing", p. 1-7.*
"ASM Handbook vol. 15 Casting", ASM International, 1988, p. 841.*
Nishikawa, Tadahiro, et al. *Preparation and Properties of Porous Zirconia/Nickel Composites*, J. Soc. Mat. Sci., Japan, Jun. 2000, vol. 49, No. 6, pp. 606-610.
Japanese Journal "*Industrial Material*," 1982,vol. 30, No. 10, pp. 76-82.

* cited by examiner

*Primary Examiner*—Roy King
*Assistant Examiner*—Janelle Morillo
(74) *Attorney, Agent, or Firm*—Burr & Brown

(57) ABSTRACT

A porous composite material includes a metal material for forming a matrix, and at least two kinds of fine particle materials having different wettabilities with respect to the metal material. The porous composite material is provided by melting and impregnating the metal material for forming a matrix with the mixture of at least two kinds of fine particle materials. The porous composite material has excellent characteristics in shock absorbency, acoustics, non-combustibility, lightness, rigidity, and so forth.

4 Claims, 2 Drawing Sheets

500 μm

POROUS METAL BASED COMPOSITE MATERIAL

BACKGROUND OF THE INVENTION

1. Field of the Invention

The present invention relates to a porous metal based composite material which requires no pressuring mechanism during manufacture due to the spontaneous penetration of a metal which will become a matrix, or which can be manufactured under low pressure even if pressure is required, and the characteristic control thereof.

2. Description of the Related Art

Known methods of manufacturing porous materials include: (1) powder metallurgy techniques to sinter metal powders or short fibers; (2) directly adding a foam material to molten metal; (3) plating on foam plastic and removing the plastic; (4) forming a compound from a material having a small density, such as a foam material, and a metal; and (5) blowing gas into molten metal under zero gravity, for example.

However, in consideration of these methods, including the aspect of making a metal-based composite material porous, the powder metallurgy method (1) is uneconomical although the manufacture of Ti or Ti alloy stainless steel has been attempted. As an example of the method (2), Al alloy is foamed by using a hydride such as Ti and Zr. In this method, it is difficult to select a foam material for a steel material. It is also difficult to provide an even structure by foaming a composite material of metal and non-metal or the like. In the method (3), plastic is partially used as an organic material so that the application thereof is limited, which is troublesome. As an example of the method (4), Al alloy and Shirasu balloon-pumice are compounded. However, since hot molten metal has to be pressured and injected into an inorganic material having a small density, there are restrictions on a manufacturing facility. The method (5) presents difficulties in mass-production.

On the other hand, the present inventors discovered the application of a hard brazing material for a base which has little restriction on the types and shapes of the joining members which can be joined in various ways. By adding a fine particle material to the hard brazing material to lower thermal stress, an appropriate bonding strength is kept between different members. The joining strength around a joining interface is not lowered even by thermal stress during cooling after joining at high temperature, and also no cracks are formed at weak members by thermal stress during cooling, so that it was found that two or more different member scan be joined. In other words, the present inventors found that the above-noted properties can be obtained by an adhesive composition for bonding two or more different members. The adhesive composition consists of a hard brazing material and at least two types of fine particle materials having different wettabilities with respect to the hard brazing material. The present inventors thus applied for Japanese Patent Application No. 11-300184 as of Oct. 21, 1999. However, since this invention focuses on joining, there was not enough examination concerning the specific thickness of the adhesive composition or the application of the adhesive composition as a member itself at the time of the application.

SUMMARY OF THE INVENTION

Accordingly, it is an object of the present invention to provide a porous composite material which has an excellent coefficient of thermal expansion, Young's modulus, proof stress and so forth, and in particular, a porous composite material that is simple for industrial applications and can be economically manufactured.

It is effective to make a material porous by controlling mechanical properties and physical properties. A porous material has excellent characteristics as a functional material, including shock absorbency, acoustic characteristics, non-combustibility, lightweight, rigidity and so forth, and a wide range of applications is expected. For instance, the material may be a shock absorbing material for the interior and exterior of a vehicle. As a building material, sound-absorbing properties, in addition to being non-combustible and lightweight, can also be expected. Then, the applicability of the adhesive composition was examined not only as an adhesive composition to fill in the gaps of joining materials but also as a large member product and as a porous material of the member. When molten metal permeates into the mixture of fine particle materials having different wettabilities with respect to the molten metal, it is necessary to provide a fixed or higher level of penetration force by choosing the conditions of a matrix metal, fine particle material and so forth. Additionally, the powders having different wettabilities are mixed to provide an evenly porous material. Thus, it was found that a member having a desirable size can be manufactured and an effective porous composite material can be obtained.

While focusing on this fact, the present inventors carried out various tests in order to solve the above-noted problems. Accordingly, a porous metal material including a metal material for forming a matrix and at least two fine particle material shaving different wettabilities with respect to the metal material is provided by melting and impregnating the metal material into the mixture of the at least two fine particle materials. The inventors found that the porous metal material is a composite material having an excellent balance of mechanical and physical characteristics that are different from those of the matrix metal, for instance, a characteristic balance between a low expansion coefficient and low proof stress, and so forth, thus completing the present invention.

In other words, it was found that a porous metal material is provided by using a specific metal material as a matrix and by melting and impregnating the metal material into a mixture of fine particle materials which can lower thermal stress, thus forming a composite. The porous metal material can achieve the above-noted properties as a material having excellent physical and mechanical characteristics because of the metal matrix material, the fine particle material that has superior wettability with respect to the metal material can lower thermal stress, and the holes that are formed by particles having inferior wettability with respect to the metal material, thereby achieving the present invention.

DETAILED DESCRIPTION OF THE INVENTION

Figure 1:
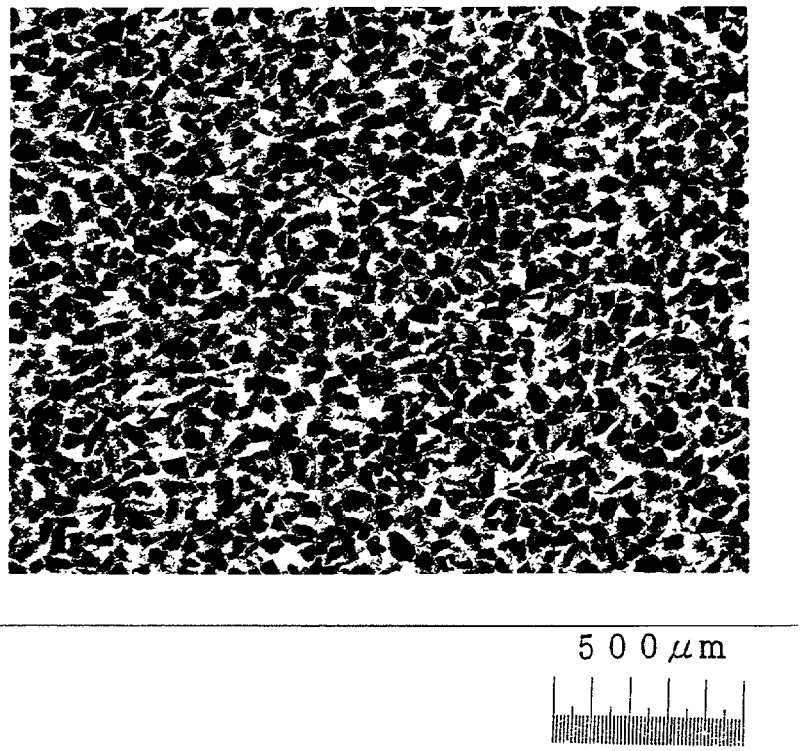
FIG. 1 is an optical microscopic photograph, showing the microstructure of a composite material in which aluminum alloy A5005 penetrated and solidified in a plated fine particle material (alumina having the average particle size of 50 μm)

According to a first aspect of the present invention, the present invention relates to a porous metal based composite material which includes a metal material for forming a matrix and at least two kinds of fine particle materials having different wettabilities with respect to the metal material, and which is provided by melting and impregnating the metal matrix material into the at least two kinds of fine particle materials.

It is preferable that the metal material for forming a matrix is Au, Ag, Cu, Pd, Al, Fe, Cr, Co or Ni, or an alloy containing these metals as a main component. Moreover, the mixture of at least two kinds of fine particle materials having different wettabilities with respect to the metal material is preferably a mixture of at least one type of surface-treated fine particles selected from the group consisting of ceramic fine particles, cermet fine particles and metal fine particles and at least one type of surface untreated fine particles selected from the group consisting of ceramic fine particles, cermet fine particles and metal fine particles. Furthermore, it is preferable that the mixture of at least two kinds of fine particle material shaving different wettabilities with respect to the metal material contains the surface untreated fine particle material and the surface treated fine particle material at the volume ratio in a range of 80:20 to 5:95. Additionally, a second aspect of the present invention relates to the application of the above-noted porous metal based composite material as a shock-absorbing material, a vibration-absorbing material or a sound-absorbing material.

Combinations of a material having superior wettability with respect to the metal material and a material having inferior wettability with respect to the metal material, for example, include ceramic fine particles that are surface treated, such as by plating, and ceramic fine particles that are not surface treated, respectively. Additional examples include a mixture of metal fine particles that are surface treated by plating or that are not surface treated, depending upon the type of metal particle and the metal matrix, and surface untreated ceramic fine particles, respectively. There is no particular limitation on a plating method. However, electroless plating is preferable.

Wettabilities with respect to the metal matrix material can be kept even without metal plating by mixing an additive such as Ti to the metal material or to the fine particle materials as fine particles, and thus forming a reaction layer of active materials such as nitride, oxide and carbide on a surface of the fine particles, such as ceramic particles, when the metal matrix material is melted and impregnated into the fine particle mixture. In this case, the above-mentioned effects can be obtained by combining materials having different wettabilites with respect to the metal material containing the additive. The effects can be preferably obtained by the combination of dispersion materials, for instance, nitride and oxide or nitride and carbide. The amount of the active materials is preferably around 0.5 to 5% in a weight ratio relative to the amount of the metal material for forming a matrix.

Moreover, each average particle size of the at least two kinds of fine particle materials having different wettabilities with respect to the metal material may be similar to each other or different from each other. Particle sizes can also be selected over a wider range than the sizes when the materials are used as an adhesive composition. In other words, the mixture of at least two kinds of fine particle materials having different wettabilities with respect to the metal material can be easily prepared by mixing, for instance, surface treated alumina particles that are Ni-plated at about 0.3 μm and have a desirable average particle size of 50 μm, and, for example, surface untreated alumina particles that have a desirable average particle size of 50 μm.

Or, alternatively, the mixture can be easily prepared by mixing, for instance, surface treated alumina particles that are Ni-plated at about 0.5 μm and have a desirable average particle size of 50 μm, and, for example, surface untreated Shirasu balloon particles that have a desirable average particle size of 100 μm. The mixture of the at least two kinds of fine particles having different wettabilities with respect to the metal material and containing Ti or the like as an additive in a fixed amount can be easily prepared by mixing, for instance, aluminum nitride having a desirable average particle size of 50 μm and, for example, alumina particles having a desirable average particle size of 50 μm.

A mixing ratio between the surface untreated fine particle material and the surface treated fine particle material is more preferably 1:9. In other words, the mixing ratio of the surface untreated fine particle material to the total of all the particles of the mixture is in a range of about 10% to 3:1, in other words, around 75%. When the mixing ratio of the surface untreated material is higher than 3:1, the metal matrix material cannot easily penetrate the mixture without pressure and pressurization or the like is often required, which is not preferable. Moreover, when the mixing ratio of the surface untreated material is lower than 1:9, the mechanical properties of the composite material becomes similar to that of a compact filler, which is not preferable. The composite material of the present invention may be generally manufactured in accordance with the conditions described in Japanese Patent Application No. 11-180902. The surface treated fine particle material does not have to be the same as the surface untreated fine particle material. The mixture is acceptable as long as it is a proper combination of surface treated fine particle materials and surface untreated fine particle materials. In other words, it is unnecessary to use the same material for the plated and non-plated materials.

The metal material for forming a matrix for use in the composite material according to the present invention includes pure metal such as Au, Ag, Cu, Pd, Al, Fe, Cr, Co or Ni, or an alloy having these metals as a main component. For the alloy containing these metals as a main component, at least one kind of the above-noted metals may be contained as the main component. Of course, metals other than the metals mentioned above may also be contained. Appropriate metals or an alloy may be selected for use based on the reactivity between the particles and a dispersion material or the temperature under which the composite material is used. Al alloy, for instance, BA4004 (Al-10Si-1.5Mg), A5005 (Al-0.8Mg) and so forth is preferably used since a light composite member can be obtained, and the manufacturing temperature can be low.

In melting and impregnating the pure metal or alloy material into the particle materials, it is important to improve wettability between the particles having superior wettability and molten metal in order to improve the penetration force of the molten metal and to enlarge a composite material to a desirable level.

Generally, the wettability of a molten metal or the like is expressed by the following Young-Dupre equation in which a drop is placed on the surface of a solid (sessile drop method) and in which each surface energy is in balance at solid/liquid/gas interfaces under the following condition:

$$\gamma_{SV}=\gamma_{S1}+\gamma_{1V}\times\cos\theta;$$

wherein θ is a contact angle, $\gamma_{SV}$ is solid-gas surface energy, $\gamma_{1V}$ is gas-liquid surface energy, and $\gamma_{S1}$ is solid-liquid surface energy.

In general, a system having good wettability is θ<90°, and a system having poor wettability is θ>90°. In order to improve wettability (θ<90°) based on the equation mentioned above, it is necessary to set the solid-gas surface energy $\gamma_{SV}$ high and the gas-liquid surface energy $\gamma_{1V}$ and the solid-liquid surface energy $\gamma_{S1}$ low. Thus, although an oxide film is formed on the surface of a metal which is coated on the fine particle material having superior wettability with respect to the molten metal during heating before melting and impregnating the metal, the oxide has small surface energy (solid-gas surface energy $\gamma_{SV}$) and is stable, so that the wettability of the material coated with the oxide film thereon is poor. Therefore, when the oxide is removed in a reduction atmosphere or the like, the surface becomes active, having large surface energy (solid-gas surface energy $\gamma_{SV}$), and wettability increases. It is desirable to prevent oxidation under high vacuum. It is also possible to lower the solid-gas surface energy $\gamma_{SV}$ to improve wettability by changing the components of molten liquid with an added element or the like.

The joining strength between the fine particle materials dispersed in the metal matrix material and the metal matrix material is partially reduced, or fine holes are positively formed in the composite material. Thus, a porous metal-based composite material provided by reducing Young's modulus and proof stress, in addition to coefficient of thermal expansion, can provide a cushioning effect when the material is joined to another member having low coefficient of thermal expansion and low fracture toughness. Additionally, a composite material having excellent heat resistance can be provided. More specifically, the effects can be achieved by mixing the dispersion material dispersed in the metal material with the particles having superior wettability with respect to the metal material, and the particles having inferior wettability with respect to the metal material. As the mixture of the particles having superior wettability and the particles having inferior wettability with respect to the metal material, it is preferable to use particles that are surface treated by plating, for example, to maintain the desired wettability with respect to the metal material, and particles that are not surface treated to maintain the desired wettability, or a nitride and oxide, metal particles and an oxide, and so forth.

When the ratio of the particles having superior wettability with respect to the metal material is high, the microstructure of the optically observed porous metal based composite material is not so different from that of a composite material formed only of surface treated particles. However, the coefficient of thermal expansion and Young's modulus of the porous material are reduced by as much as those of a composite material formed only of particles having superior wettability. The proof stress of the porous material is reduced by more than that of a composite material formed only of surface treated particles. This is because joining strength between the particles having inferior wettability and the metal material is reduced in comparison with the particles having superior wettability. Thus, parts with the particles having inferior wettability essentially function as holes, and it is considered that the characteristics of a composite material could be controlled in a desirable direction.

As the ratio of the particles having inferior wettability with respect to the metal material increases, optically observable holes are formed in a porous metal based composite material, and the coefficient of thermal expansion declines by as much as that of a composite material formed only of particles having superior wettability. Additionally, Young's modulus and proof stress decrease further in comparison with a composite material having less particles with inferior wettability with respect to the metal material. This is because the cross section of a composite material visually decreases because of holes, in addition to the decrease in joining strength between a dispersion material and the metal material, in the composite material with more particles having inferior wettability with respect to the metal material. Accordingly, Young's modulus decreases, and proof stress decreases since parts adjacent to the holes or the like become crack generating points during loading.

The effects of the porous metal based composite material according to the present invention were explained in accordance with the amount of particles that are not surface treated such as by plating to keep wettability, for the sake of convenience. However, the object, method and effects are all the same, and it is almost unnecessary to strictly distinguish whether or not they can be recognized as optical holes.

For the characteristic control of the composite material, it is necessary to arrange the kinds of fine particle materials and adjust the packing density relative to the metal matrix material. The packing density of fine particle materials relative to the metal matrix material is in a range of 30 to 90%, preferably in a range of 40 to 70%, in volume ratios when only particles having superior wettability with respect to the metal matrix material are dispersed. The packing densities are effective in controlling the coefficient of thermal expansion of a formed material in particular.

When the particles having superior wettability to the metal matrix material and the particles having inferior wettability to the metal matrix material are dispersed, the volume ratio of the particles is similarly set in a range of 30 to 90%, preferably in a range of 40 to 70%, based on the assumption that the composite material has no holes. It is also advantageous to increase the packing density of the particle materials in order to lower the coefficient of thermal expansion. However, if the packing density is increased too much, it would be difficult for the melted matrix material to penetrate the particles, which is not preferable. When the packing density is low and the coefficient of thermal expansion is lower than a desirable level, particles cluster on one side during manufacture and a homogeneous material is not often provided. In other words, the coefficient of thermal expansion is adjusted by selecting the kinds of fine particle materials, or by appropriately selecting the particle size distribution of the fine particle materials.

EXAMPLES

The present invention will be explained in further detail by referring to examples. However, the present invention is not limited to these examples.

Example 1

Alumina particles that were Ni-plated at a thickness of 0.3 μm on the surface thereof and had an average particle size of 50 μm, and alumina particles that were not surface treated and had an average particle size of 50 μm were mixed at each ratio of 1:0, 2:1, 1:1 and 1:2. The fine particles were mixed at each of the ratios and filled in a graphite jig. Subsequently, pure aluminum A1050 (Al>99.5%) or aluminum alloy A5005 (Al-0.8Mg) was arranged on the particles, was melted, penetrated into the particle mixture without pressure, and was solidified, thus providing a sample composite material. The mechanical and physical characteristics of the sample are shown in Table 1. In Table 1, the degree of penetration was determined by whether or not molten matrix metal penetrated evenly through the thickness of the layer of the fine particles filled in the jig.

Figure 2:
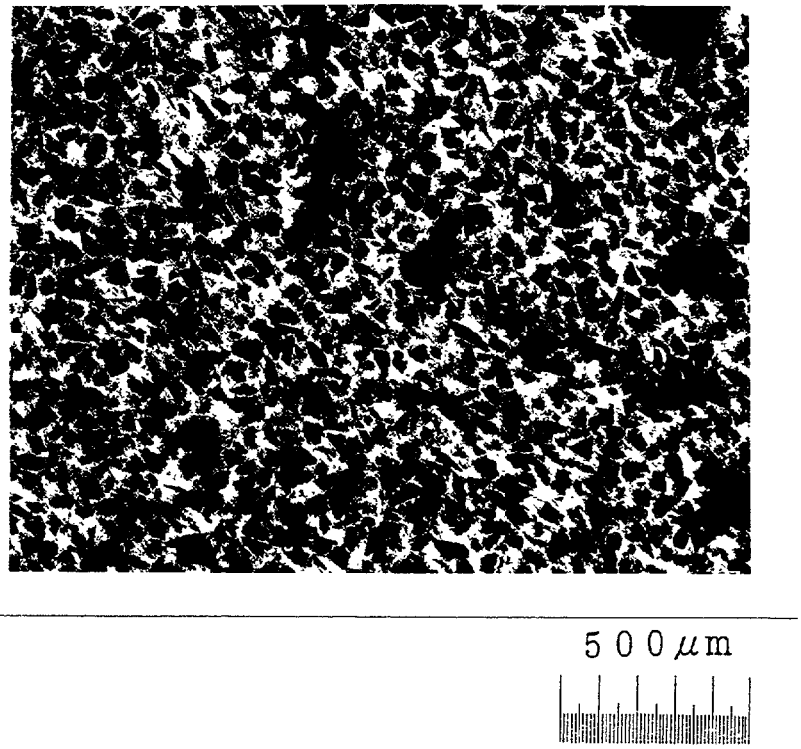
FIG. 2 is an optical microscopic photograph, showing the microstructure of a composite material in which aluminum alloy A5005 penetrated and solidified in particles where a plated fine particle material (alumina having the average particle size of 50 μm) and a non-plated fine particle material (alumina having the average particle size of 50 μm) were mixed at 2:1.
Figure 3:
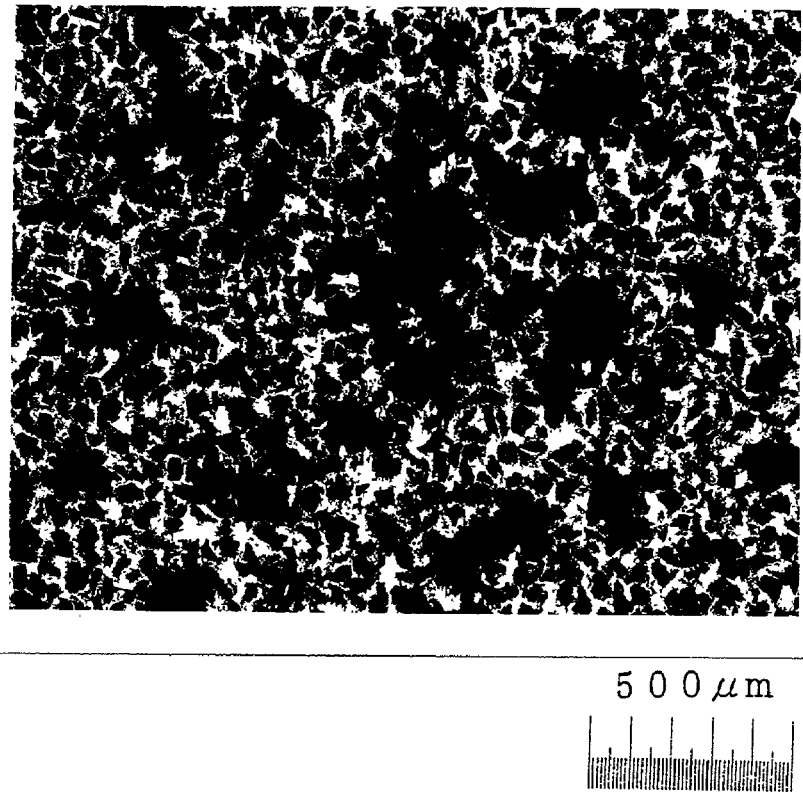
FIG. 3 is an optical microscopic photograph, showing the microstructure of a composite material in which aluminum alloy A5005 penetrated and solidified in particles where a plated fine particle material (alumina having the average particle size of 50 μm) and a non-plated fine particle material (alumina having the average particle size of 50 μm) were mixed at 1:2.

FIG. 1, FIG. 2 and FIG. 3 are optical microscopic photographs, showing typical microstructures. FIG. 1 is an optical microscopic photograph, showing the microstructure of a composite material in which aluminum alloy A5005 penetrated and solidified in a plated fine particle material (alumina having the average particle size of 50 μm). FIG. 2 is an optical microscopic photograph, showing the microstructure of a composite material relating to the present invention in which aluminum alloy A5005 penetrated and solidified in particles where a plated fine particle material (alumina having the average particle size of 50 μm) and a non-plated fine particle material (alumina having the average particle size of 50 μm) were mixed at 2:1. FIG. 3 is an optical microscopic photograph, showing the microstructure of a composite material relating to the present invention in which aluminum alloy A5005 penetrated and solidified in particles where a plated fine particle material (alumina having the average particle size of 50 μm) and a non-plated fine particle material (alumina having the average particle size of 50 μm) were mixed at 1:2.

TABLE 1

| Matrix alloy | Plating thickness (μm) | Mixing ratio of plated particles (%) | Coefficient of thermal expansion ($\times 10^{-6}$) | Young's modulus (GPa) | Yield strength (MPa) | Penetration |
|---|---|---|---|---|---|---|
| A1050 | 0.3 | 100 | 13.4 | 54 | 33 | Partially difficult to penetrate |
| A1050 | 0.3 | 67 | 13.5 | — | — | Partially difficult to penetrate |
| A1050 | 0.3 | 50 | — | — | — | Difficult to penetrate |
| A1050 | 0.3 | 33 | — | — | — | Difficult to penetrate |
| A5005 | 0.3 | 100 | 13.3 | 110 | 72 | Good |
| A5005 | 0.3 | 67 | 13.2 | 95 | 69 | Good |
| A5005 | 0.3 | 50 | 13.5 | 55 | 44 | Good |
| A5005 | 0.3 | 33 | 13.4 | 45 | 39 | Good |

Note:
In the table, — indicates no measurement or unmeasurable.

Example 2

Alumina particles that were Ni-plated at the thickness of 0.3 μm on the surface thereof had an average particle size of 50 μm, and alumina particles that were not surface treated and had an average particle size of 50 μm, were mixed at the ratio of 2:1. Dispersion particles were mixed at the ratio and filled in a graphite jig. Subsequently, pure aluminum A1050 (Al>99.5%) or aluminum-magnesium alloy (Al-0.18 to 2.308Mg) was arranged on the particles, melted, penetrated into the particle mixture without pressure, and was solidified, thus providing a sample composite material. The mechanical and physical characteristics of the sample are shown in Table 2. In Table 2, the degree of penetration was determined by whether or not molten matrix metal penetrated evenly to the degree of penetration was determined by whether or not molten metal penetrated evenly through the thickness of the layer of the dispersion particles filled in the jig.

TABLE 2

| Matrix alloy | Plating thickness (μm) | Mixing ratio of plated particles (%) | Penetration | Young's modulus (GPa) | Yield strength (MPa) |
|---|---|---|---|---|---|
| Al (>99.5) | 0.3 | 67 | Difficult to penetrate | — | — |
| Al - 0.18 Mg | 0.3 | 67 | Difficult to penetrate | — | — |
| Al - 0.41 Mg | 0.3 | 67 | Good | 83 | 63 |
| Al - 0.62 Mg | 0.3 | 67 | Good | 89 | 66 |
| Al - 0.81 Mg | 0.3 | 67 | Good | 95 | 69 |
| Al - 1.08 Mg | 0.3 | 67 | Good | 104 | 72 |
| Al - 2.30 Mg | 0.3 | 67 | Good | 122 | 84 |

Note:
In the table, — indicates no measurement or unmeasurable.

Clearly shown in the above-noted results, impregnation characteristics improve with the increase in the amount of added Mg. This is because Mg effectively reduces solid-liquid surface energy as shown above.

The porous metal based composite material according to the present invention is a superior composite material that can be manufactured while mechanical and physical characteristics such as coefficients of thermal expansion, Young's modulus and proof stress are simply and effectively controlled at preferable levels. Moreover, the porous metal based composite material according to the present invention is reliable, with no damage, since stress among materials is reduced, so that an excellent composite material can be provided.

What is claimed is:

1. A porous metal-based composite material comprising:

a metal matrix material;

a mixture of at least two fine particle materials having a packing density in a range of 40 to 90 vol. %, said at least two fine particle materials comprising a first fine particle material having superior wettability with respect to said metal matrix material and a second fine particle material having inferior wettability with respect to said metal matrix material, wherein a volume mixing ratio of said first fine particle material to said second fine particle material in said mixture is in a range of 80:20 to 5:95, and wherein said mixture of at least two fine particle materials consists of at least one of a combination of (i) surface treated oxide ceramic particles and non-surface treated ceramic particles, and (ii) surface treated metal particles and non-surface treated ceramic particles; and holes defined at least in part by said second fine particle material having inferior wettability with respect to said metal matrix material;

wherein said porous metal-based composite material is formed by providing said metal matrix material in solid form in contact with said mixture and then melting said metal matrix material and impregnating said metal matrix material into said mixture.

2. The porous metal-based composite material of claim 1, wherein said metal matrix material comprises at least one of Au, Ag, Cu, Pd, Al, Fe, Cr, Co, Ni and an alloy containing these metals as a main component.

3. The porous metal-based composite material of claim 1, wherein said holes have a size which is larger than a size of said fine particle materials.

4. The porous metal-based composite material of claim 3, wherein said size of said fine particle materials is about 50 μm.

* * * * *

UNITED STATES PATENT AND TRADEMARK OFFICE

CERTIFICATE OF CORRECTION

PATENT NO. : 7,329,384 B2
APPLICATION NO. : 09/957730
DATED : February 12, 2008
INVENTOR(S) : Masayuki Shinkai and Masahiro Kida It is certified that error appears in the above-identified patent and that said Letters Patent is hereby corrected as shown below:

On the title page, item [56]:

Title Page, Foreign Patent Documents

*Please change*: "JP 01-132763 A 05/1989" to --JP 01-132736 A 05/25/1989--

Signed and Sealed this

Twenty-second Day of July, 2008

JON W. DUDAS
*Director of the United States Patent and Trademark Office*